US006481103B2

(12) United States Patent
Van Hout et al.

(10) Patent No.: US 6,481,103 B2
(45) Date of Patent: Nov. 19, 2002

(54) ELECTRIC SHAVING APPARATUS

(75) Inventors: Johannes A. M. Van Hout, Drachten (NL); Hendrik Poel, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/822,444

(22) Filed: Mar. 30, 2001

(65) Prior Publication Data

US 2002/0011003 A1 Jan. 31, 2002

Related U.S. Application Data

(63) Continuation-in-part of application No. 09/164,476, filed on Oct. 1, 1998, now abandoned.

(51) Int. Cl.[7] ..... B26B 15/02
(52) U.S. Cl. ..... 30/34.1

(58) Field of Search ..... 30/34.1, 50, 527

(56) References Cited

U.S. PATENT DOCUMENTS 4,930,217 A * 6/1990 Wolf et al. ..... 30/34.1

* cited by examiner

*Primary Examiner*—Douglas D. Watts

(57) ABSTRACT

The invention relates to an electrically driven shaving apparatus of the type having a reciprocating cutter (6). The cutter is situated in a shaving head (2) which is freely pivotable between two positions. The shaving apparatus also comprises a trimmer (4), which is movable from a non-driven rest position (17) into a driven operating position (18). In this operating position the shaving head (2) is pivoted away into a locking position (19), in which position the cutter (6) is not driven. The advantage is that all the motor power is available for driving the trimmer.

4 Claims, 3 Drawing Sheets

ELECTRIC SHAVING APPARATUS

RELATED APPLICATIONS

This is a continuation-in-part of application Ser. No. 09/164,476, filed Oct. 1, 1998 now abandoned. A CPA of which was filed Dec. 27, 2000.

BACKGROUND OF THE INVENTION

The invention relates to an electric shaving apparatus having a housing, a shaving head which is freely pivotable with respect to the housing between a first and a second position and which comprises at least one upper cutter and at least one lower cutter adapted to cooperate with said upper cutter, a drive element, coupled to the lower cutter for driving the lower cutter, a trimmer which can be set from a rest position into an operating position, in which the trimmer is drivable by the motor, and vice versa, the shaving head being pivoted out of a central position, situated between the first and the second position, when the trimmer is set into its operating position.

Such a shaving apparatus is known from EP-B1-0 302 268 to which corresponds substantially with U.S. Pat. No. 4,930,217 the disclosure of which is hereby incorporated by reference. In the operating position of the trimmer of said shaving apparatus both the trimmer for cutting long hairs and the lower cutter for cutting short hairs are driven in order to obtain a combined cutting system. However, in practice, it appears that simultaneous driving of the trimmer and the lower cutter demands a comparatively high motor power, which adversely affects the performance of the trimmer. This is of particular importance in battery-powered shavers.

SUMMARY OF THE INVENTION

It is an object of the invention to improve the shaving apparatus of the type defined in the opening paragraph in such a manner that more power is available for driving the trimmer.

To this end, the shaving apparatus in accordance with the invention is characterized in that the shaving head has been pivoted into a locking position when the trimmer is in its operating position, which locking position is situated further away from the central position than said first or second position and in which locking position the drive element is disengaged from the lower cutter.

This means that the lower cutter of the shaving head is not driven when the trimmer is in its operating position, so that substantially all the available motor power is used for driving the trimmer.

A preferred embodiment of such a shaving apparatus is characterized in that the lower cutter has a recess which is oriented transversely to the driving direction of the lower cutter, in which recess the driving element is disposed, which recess has a widened portion at one end, in which widened portion the drive element is disposed when the shaving head is in its locking position and in which position the drive element moves freely in the widened portion of the recess without driving the lower cutter.

BRIEF DESCRIPTION OF THE DRAWINGS

An embodiment of the invention will now be described in more detail, by way of example, with reference to the drawings. In the drawings.

DESCRIPTION OF THE PREFERRED EMBODIMENTS

Figure 1:
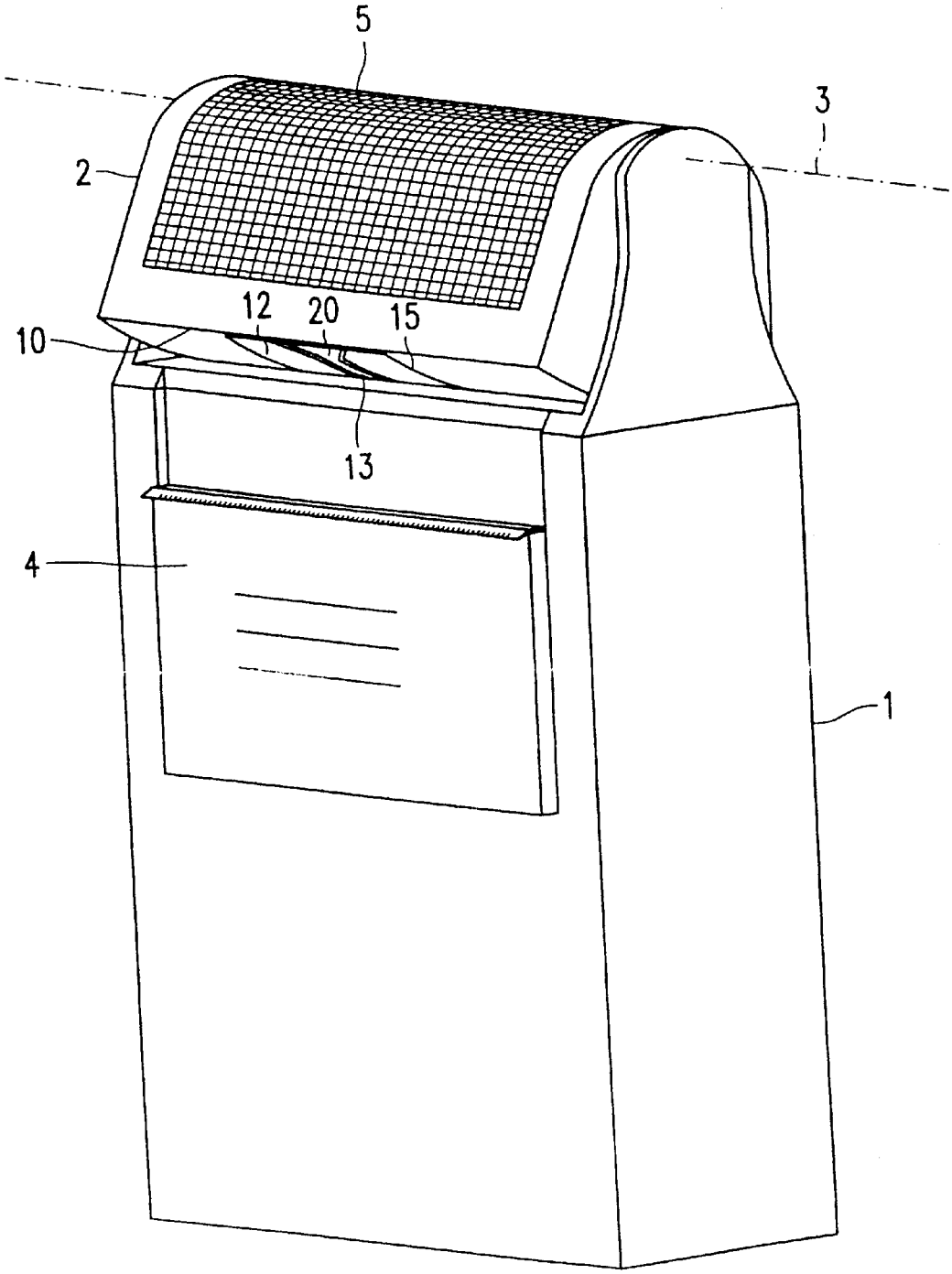
FIG. 1 is a perspective view of a shaving apparatus in accordance with the invention.
Figure 2:
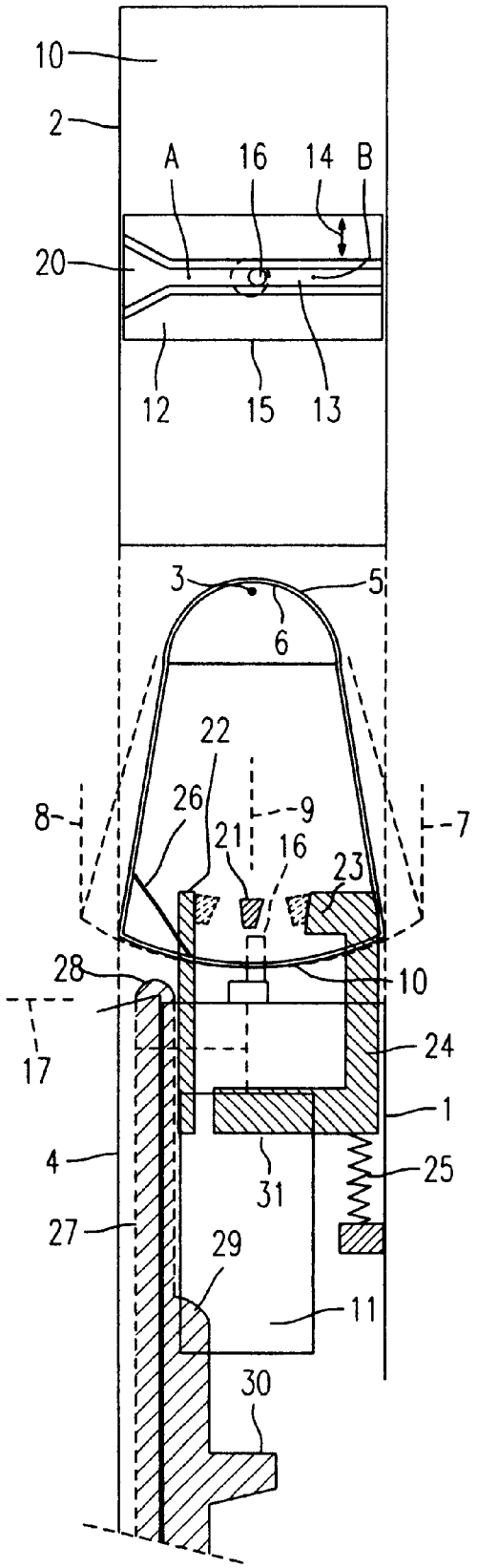
FIG. 2 is a diagrammatic representation of the shaving apparatus of FIG. 1, the trimmer being shown in its rest position.
Figure 3:
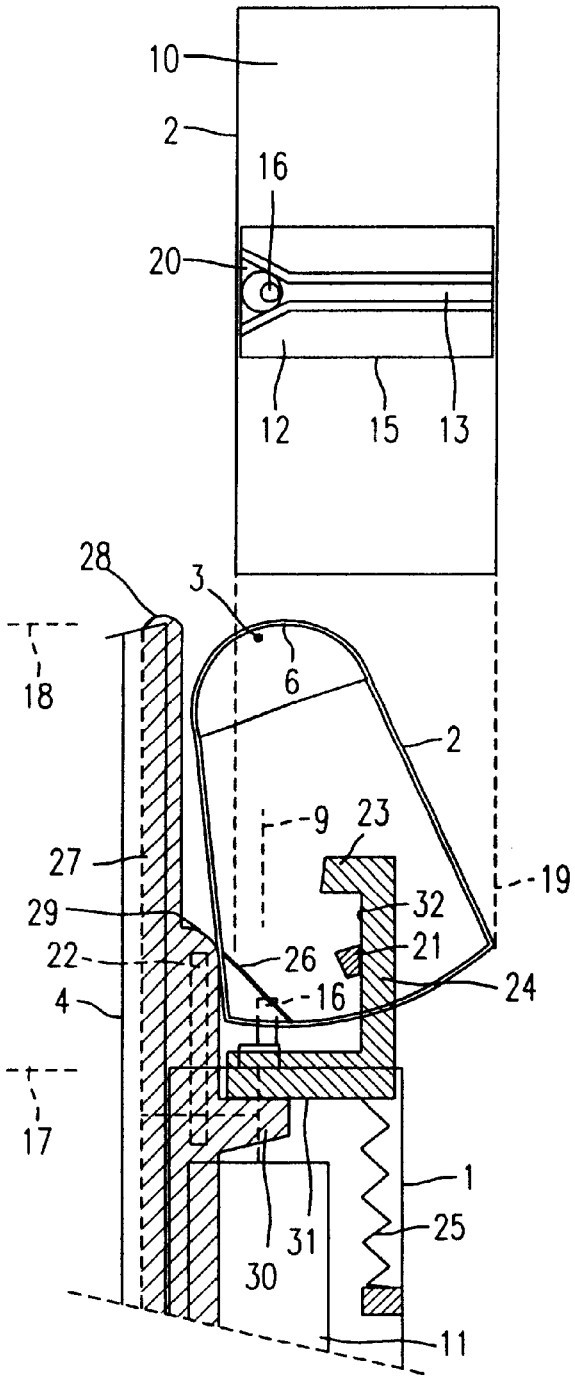
FIG. 3 is a diagrammatic representation similar to that in FIG. 2, the trimmer being shown in its operating position and the drive of the lower cutter of the shaving head being disengaged.

The shaving apparatus of FIG. 1 has a housing 1 provided with a shaving head 2, which is pivotable about an axis 3, and with a trimmer 4, which is mounted in the housing so as to be slidable. The shaving head 2 has an upper cutter 5 and a lower cutter 6 adapted to cooperate with said upper cutter. However, alternatively the shaving head may comprise a plurality of upper cutters combined with lower cutters. FIG. 2 represents diagrammatically a first position 7 and a second position 8 between which the shaving head 2 can pivot freely with respect to a central position 9. The upper parts of FIGS. 2 and 3 show diagrammatically the underside 10 of the shaving head. The lower cutter is driven by a motor 11. For this purpose, the lower cutter 6 or an element connected thereto, has a recess 13, which is oriented transversely to the direction of movement 14 of the lower cutter. The underside 10 of the shaving head has an opening 15 at the location of the recess 13. A drive element in the form of an eccentric pin 16 engages in this recess. The eccentric pin is driven by the motor 11 so as to perform a rotary movement. As a result of this, the lower cutter 6 performs a reciprocating movement. The recess 13 has an elongate shape so as to enable the shaving head to be pivoted when the lower cutter is driven. In the upper part of FIG. 2 the points A and B indicate the positions between which the eccentric pin 16 can slide in the recess 13 during the pivotal movement of the shaving head in the normal shaving mode. During this normal shaving mode the eccentric pin 16 always remains in the recess between the points A and B. To provide for this, the shaving head 2 is provided with a cam 21 and the housing is provided with two abutments 22 and 23. Abutment 22 is fixed. Abutment 23 is part of U-shaped slide 24. Slide 24 is movable in a vertical direction, in the housing, against the force of tension spring 25. Cam 21 is pivotable about axis 3 between the abutments 22 and 23 which correspond to the points A and B. In the situation shown in FIG. 2 the trimmer 4 is in a rest position 17, i.e. the trimming cutter is not driven.

When the trimmer 4 is to be used, it is slid upwards, past the shaving head 2 into an operating position 18, in which the trimming cutter is driven by the motor 11. During this upward movement the shaving head pivots into a locking position 19, as shown in FIG. 3. This is carried out in the following manner: The shaving head 2 is provided with an oblique sliding surface 26. The trimmer 4 is provided with a two step locking element 27. This locking element has a rounded top edge 28, a rounded step portion 29 and a push cam 30. When the trimmer 4 is moved upwards, first the rounded top edge 28 slides along the sliding surface 26 causing the shaving head 2 to pivot over a certain angle. The eccentric drive pin 16 still engages the recess 13. The cam 21 does not reach the abutment 23. Upon further upward movement of the trimmer 4, the push cam 30 reaches the flower surface 31 of the slide 24 and pushes the slide upwards thereby causing the abutment 23 to reach a position above the cam 21. The cam 21 is now able to move under the abutment 23. Upon further upward movement of the trimmer 4, the rounded step portion 29 slides along the oblique sliding surface 26 causing the shaving head 2 to pivot further counterclockwise until the trimmer 4 reaches its uppermost position. The cam 21 then pivots underneath the abutment 23 until it reaches wall portion 32 of the slide 24. The shaving head 2 has now reached its locking position 19. The locking position 19 is situated further away from the central position 9 of the shaving head than said first or second pivoted position 7, 8. As a result of this, the eccentric pin 16 engages in a V-shaped widened portion 20 of the recess 13. This widened portion is so large that it allows the eccentric pin to rotate freely without driving the lower cutter 6. In this slid-out operating position 18 of the trimmer the lower cutter is consequently disengaged from the drive element, as a result of which the entire motor power is available for driving the trimmer. When the trimmer 4 is moved back to its inoperative position the shaving head 2 should pivot back in the direction of the central position 9 to avoid the cam 21 being jammed under the abutment 23. For this purpose the shaving head 2 can be provided with spring means (not shown) which forces the shaving head 2 back to its center position.

Instead of a motor having a rotating output shaft coupled to an eccentric pin for a reciprocating drive of the lower cutter it is possible to use a linearly driven vibratory motor which directly reciprocates a drive element or pin.

What is claimed is:

1. An electric shaving apparatus having a housing, a shaving head which is freely pivotable with respect to the housing between a first and a second position and which comprises at least one upper cutter and at least one lower cutter adapted to cooperate with said upper cutter, a drive element, coupled to the lower cutter for driving the lower cutter, a trimmer which can be set from a rest position, in which the trimmer is not driven by the motor, into an operating position, in which the trimmer is driven by the motor, and from said operating position into said rest position, the shaving head being pivoted out of a central position, situated between the first and the second position, when the trimmer is set into its operating position, wherein the shaving head is pivoted into a locking position when the trimmer is in its operating position, which locking position is situated further away from the central position than said first or second position and in which locking position the drive element is disengaged from the lower cutter.

2. An electric shaving apparatus as claimed in claim 1, wherein the lower cutter has a recess which is oriented transversely to the driving direction of the lower cutter, in which recess the driving element is disposed, which recess has a widened portion at one end, in which widened portion the drive element is disposed when the shaving head is in its locking position and in which position the drive element moves freely in the widened portion of the recess without driving the lower cutter.

3. An electric shaving apparatus as claimed in claim 1, wherein the trimmer is mounted in the housing so as to be slidable.

4. An electric shaving apparatus as claimed in claim 3, wherein in its operating position the trimmer is disposed adjacent the shaving head parallel to a pivotal axis of the shaving head, the shaving head being pivoted away from the trimmer into its locking position.

* * * * *